US006300848B1

(12) United States Patent
Miyaji et al.

(10) Patent No.: US 6,300,848 B1
(45) Date of Patent: Oct. 9, 2001

(54) POWER SPLITTER AND POWER COMBINER USING N-BRANCH-LINE-SHAPED DIRECTIONAL COUPLERS

(75) Inventors: Masayuki Miyaji, Takarazuka; Kaoru Ishida, Shijonawate; Hiroaki Kosugi, Hirakata; Shin'ichi Kugou, Yokosuka, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/388,414

(22) Filed: Sep. 1, 1999

(30) Foreign Application Priority Data

Sep. 1, 1998 (JP) ..... 10-247485

(51) Int. Cl.[7] ..... H01P 3/08
(52) U.S. Cl. ..... 333/116; 333/109; 333/124
(58) Field of Search ..... 333/109, 115, 333/116, 124, 26

(56) References Cited

U.S. PATENT DOCUMENTS 3,614,676 * 10/1971 Boelke ..... 333/26
4,323,863 * 4/1982 Weber ..... 333/109
5,235,296 * 8/1993 Saka ..... 333/109

* cited by examiner

*Primary Examiner*—Robert Pascal
*Assistant Examiner*—Kimberly E Glenn
(74) *Attorney, Agent, or Firm*—Ratner & Prestia

(57) ABSTRACT

According to the configuration the present power splitter, it is possible to reduce the characteristic impedance of a transmission line constituting a directional coupler by setting the impedance of a first terminal pair constituted of an input port 7*a* and a second output port 7*d* of a 6-dB branch-line-shaped directional coupler 7 to a value smaller than a reference impedance Z0 (50 Ω in general) and setting the impedance of a second terminal pair constituted of an isolation port 7*b* and a first output port 7*c* of the directional coupler 7 to Z0. Therefore, it is possible to increase the number of splits and reduce loss, as compared with conventional cases.

18 Claims, 7 Drawing Sheets

POWER SPLITTER AND POWER COMBINER USING N-BRANCH-LINE-SHAPED DIRECTIONAL COUPLERS

BACKGROUND OF THE INVENTION

1. Field of the Invention

The present invention relates to a power splitter and a power combiner mainly used for a microwave circuit.

2. Description of the Related Art

For the circuit configuration of a conventional power splitter, there is a method of combining the 3-dB directional couplers shown in FIG. 5. FIG. 5 is a four-way power splitter , in which symbol 31 denotes an input terminal, 32*a* to 32*d* denote output terminals, and 33*a* to 33*c* denote 3-dB directional couplers. Though circuit design is easy for the circuit configuration in FIG. 5, there are disadvantages that the circuit scale increases when the number of split s increases, the insertion loss increases, and only a $2^n$-way power splitter can be constituted.

Therefore, for the circuit configuration of a compact and small-loss four-way power splitter , there is a method of cascading the directional couplers having coupling degrees 6, 4.7, and 3 dB shown in FIG. 6. In FIG. 6, symbol 41 denotes an input terminal, 42*a* to 42*d* denote output terminals, 43 denotes a 6-dB directional coupler, 44 denotes a 4.7-dB directional coupler, and 45 denotes a 3-dB directional coupler. Operations of the four-way power splitter constituted as shown in FIG. 6 are described below.

An input signal (P) input through the input terminal 41 is first input to the 6-dB directional coupler 43, ¼the input signal (P), that is, a (P/4) signal is output to the output terminal 42*a*, and the remaining (3P/4) signal is input to the 4.7-dB directional coupler 44. Next, the 4.7-dB directional coupler 44 outputs ⅓ the input signal (3P/4), that is, a (P/4) signal to the output terminal 42*b* and inputs the remaining (P/2) signal to the 3-dB directional coupler 45. Then, the 3-dB directional coupler 45 divides the input signal (P/2) into two equal signals, outputs a (P/4) signal to output terminals 42*c* and 42*d* respectively, and operates as a four-way power splitter.

FIG. 7 shows a case in which the configuration in FIG. 6 is constituted of a conventional branch-line-shaped directional coupler. In FIG. 7, symbols 51 and 52 denote transmission lines, 53, 54, and 55 denote terminating resistors, 43*a* denotes an input port, 43*b* denotes an isolation port, 43*c* denotes a first output port, and 43*d* denotes a second output port, and a component same as that in FIG. 6 is provided with the same symbol.

In the case of the configuration in FIG. 7, however, a branch-line-shaped directional coupler having a large coupling degree is necessary when the number of split s increases. To constitute the above directional coupler, a transmission line having a high characteristic impedance or generally, a microstrip line is necessary. Thus, the configuration as problems that loss increases because the strip line width decreases and the machining accuracy is limited.

BRIEF SUMMARY OF THE INVENTION

The present invention is made to solve the problems of the conventional power splitter and its object is to provide a power splitter capable of increasing the number of splits or reducing loss, as compared with conventional cases.

It is another object of the present invention to provide a power combiner capable of using input ports more than ever and reducing loss compared with a conventional case in the case where the powers supplied from a plurality of inputs are combined and then output.

One aspect of the present invention is a power splitter comprising:

N branch-line-shaped directional couplers respectively constituted of four quarter-wavelenglh lines and having an input port, an isolation port, a first output port, and a second output port;

an input line; and

N+1 output lines, wherein (a-1) when the impedance of the input line is equal to the impedance of the input port of the first branch-line-shaped directional coupler, the line and the port are connected through a transmission line having an impedance equal to the above impedance or directly connected and (a-2) when the former impedance is different from the latter impedance, the line and the port are connected through a first impedance converter, (b-1) when the impedance of the second output port of the Kth (K=1, 2, . . . , N−1) branch-line-shaped directional coupler is equal to the Impedance of the input port of the (K+1)th branch-line-shaped directional coupler, the output port and the input port are connected through a transmission line having an impedance equal to the above impedance or directly connected and (b-2) when the former impedance is different from the latter impedance, the output and input ports are connected through a Kth impedance converter, (c-1) when the impedance of the second output port of the Nth branch-line-shaped directional coupler is equal to the impedance of the (N+1)th output line, the output port and the output line are connected through a transmission line having an impedance equal to the above impedance or directly connected and (c-2) when the former impedance is different from the latter impedance, the output port and the output line are connected through an (N+1)th impedance converter, and, when (1) the input port and the second output port are used as a first terminal pair and (2) the isolation port and the first output port are used as a second terminal pair, the impedance of the first terminal pair is different from the impedance of the second terminal pair in at least one of the N branch-line-shaped directional couplers.

Another aspect of the present invention is the power splitter, wherein the impedance of the second terminal pair is constituted as a reference impedance.

Still another aspect of the present invention is the power splitter, wherein the impedance of the first terminal pair is constituted as a reference impedance, and (d-1) when the impedance of the first output port of a Jth (J=1, 2, . . . , N−1) branch-line-shaped directional coupler is equal to the impedance of a Jth output terminal, the output port and the output terminal are connected through a transmission line having an impedance equal to the above impedance or directly connected and (d-2) when the former impedance is different from the latter impedance, the output port and the output terminal are connected through a Jth output impedance converter.

Yet another aspect of the present invention is the power splitter, wherein the coupling degree of the Kth branch-line-shaped directional coupler is equal to $10\times\log_{10}$ (N−K=2) (dB), (K=1, 2, . . . , N).

Still yet another aspect of the present invention is the power splitter, wherein the product between the impedance of the second output port of the Kth (K=1, 2, . . . , N−1) branch-line-shaped directional coupler and the impedance of the input port of the Kth branch-line-shaped directional coupler is equal to the second power of the characteristic impedance of the quarter-wavelength line between the input port and the second output port of the Kth branch-Line-shaped directional coupler.

A further aspect of the present invention is the power splitter, wherein the product between the impedance of the second output port of the Kth (K=1, 2, . . . , N−1) branch-line-shaped directional coupler and the impedance of the input port of the (K+1)th branch-line-shaped directional coupler is equal to the second power of the characteristic impedance of the quarter-wavelength line between the input port and the second output port of the (K+1)th branch-line-shaped directional coupler.

A still further aspect of the present invention is the power splitter, wherein the product between the impedance of the first output port of the Jth (J=1, 2, . . . , N−1) branch-line-shaped directional coupler and the impedance of the Jth output terminal is equal to the second power of the characteristic impedance of the quarter-wavelength line between the isolation port and the first output port of the Jth branch-line-shaped directional coupler.

A yet further aspect of the present invention is the power splitter, wherein the N branch-line-shaped directional couplers are constituted of microstrip lines.

A still yet further aspect of the present invention is the power splitter, wherein the impedance converter or the output impedance converter is constituted of a transmission line.

An additional aspect of the present invention is a power combiner comprising:

N branch-Line-shaped directional couplers respectively constituted of four quarter-wavelength lines and having an output port, an isolation port, a first input port, and a second input port;

an output line; and

N+1 input lines, wherein (a-1) when the impedance of the output line is equal to the impedance of the output port of the first branch-line-shaped directional coupler, the line and the port are connected through a transmission Line having an impedance equal to the above impedance or directly connected and (a-2) when the former impedance is different from the latter impedance, the line and the port are connected through a first impedance converter, (b-1) when the impedance of the second input port of the Kth (K=1, 2, . . . , N−1) branch-line-shaped directional coupler is equal to the impedance of the output port of the (K+1)th branch-line-shaped directional coupler, the input port and the output port are connected through a transmission line having an impedance equal to the above impedance or directly connected and (b-2) when the former impedance is different from the latter impedance, the input and output ports are connected through a Kth impedance converter, (c-1) when the impedance of the second input port of the Nth branch-line-shaped directional coupler is equal to the impedance of the (N+1)th input line, the input port and the input line are connected through a transmission line having an impedance equal to the above impedance or directly connected and (c-2) when the former impedance is different from the latter impedance, the input port and the input line are connected through an (N+1)th impedance converter, and, when (1)the output port and the second input port are used as a first terminal pair and (2)the isolation port and the first input port are used as a second terminal pair, the impedance of the first terminal pair is different from the impedance of the second terminal pair in at least one of the N branch-line-shaped directional couplers.

A still additional aspect of the present invention is the power combiner, wherein the impedance of the second terminal pair is constituted as a reference impedance.

A yet addition aspect of the present invention is the power combiner, wherein the impedance of the first terminal pair is constituted as a reference impedance, and (d-1) when the impedance of the first input port of the Jth (J=1, 2, . . . , N−1) branch-line-shaped-directional coupler is equal to the impedance of the Jth input terminal, the input port and the input terminal are connected through a transmission line having an impedance equal to the above impedance or directly connected and (d-2) when the former impedance is different from the latter impedance, the input port and the input terminal are connected through a Jth input impedance converter.

A still yet additional aspect of the present invention is the power combiner, wherein the coupling degree of the Kth branch-line-shape directional coupler is equal to $10\times\log_{10}$ N−K+2) (dB), (K=1, 2, . . . , N).

One aspect of the present invention is the power combiner, wherein the product between the impedance of the second input port of the Kth (K=1, 2, . . . , N−1) branch-line-shaped directional coupler and the impedance of the output port of the (K+1)th branch-line-shaped directional coupler is equal to the second power of the characteristic impedance of the quarter-wavelength line between the output port and the second input port of the Kth branch-line-shaped directional coupler.

Another aspect of the present invention is the power combiner, wherein the product between the impedance of the second input port of the Kth (K=1, 2, . . . , N−1) branch-line-shaped directional coupler and the impedance of the output port of the (K+1)th branch-line-shaped directional coupler is equal to the second power of the characteristic impedance of the quarter-wavelength line between the output port and the second input port of the (K+1)th branch-line-shaped directional coupler.

Still another aspect of the present invention is the power combiner, wherein the product between the impedance of the first input port of the Jth (J=1, 2, . . . , N−1) branch-line-shaped directional coupler and the impedance of the Jth input terminal is equal to the second power of the characteristic impedance of the quarter-wavelength line between the isolation port and the first input port of the Jth branch-line-shaped directional coupler.

Still yet another aspect of the power combiner, wherein the N branch-line-shaped directional couplers are constituted of microstrip lines.

A further aspect of the power combiner, wherein the impedance converter or the input impedance converter is constituted of a transmission line.

DESCRIPTION OF SYMBOLS

Figure 1:
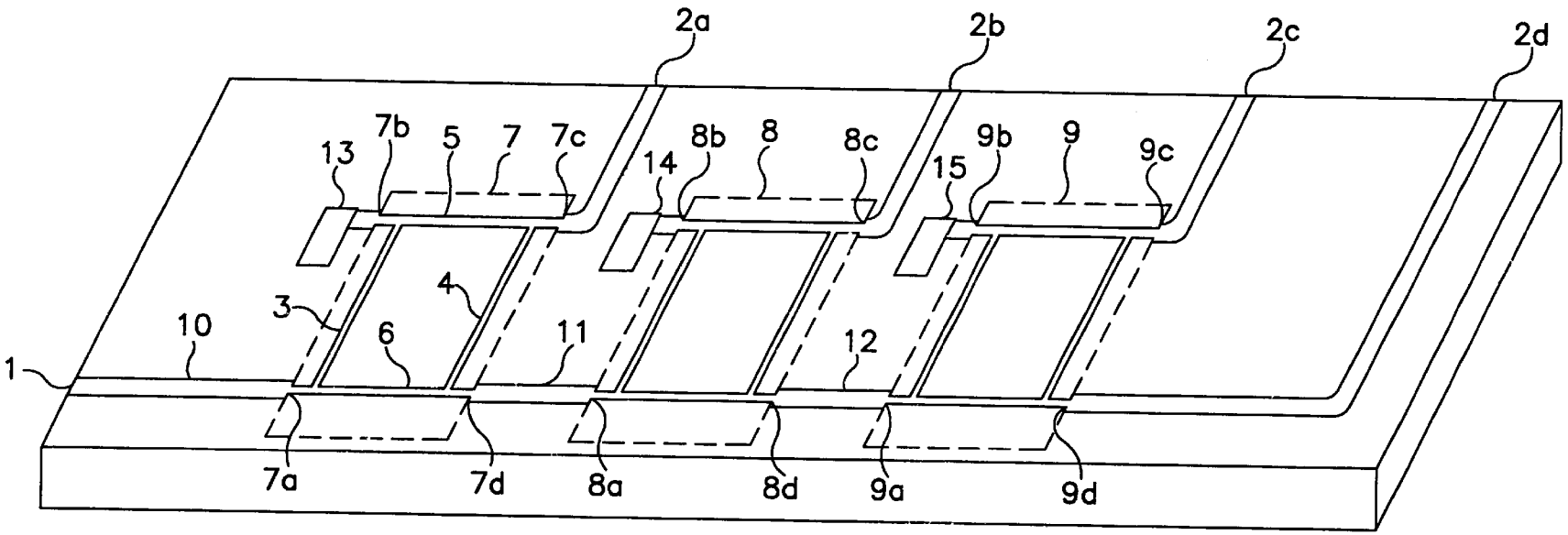
FIG. 1 is a block diagram of the four-way power splitter of embodiment 1 of the present invention.

1 Input line
2*a* to 2*d* Output line
3, 4 Microstrip line of characteristic impedance Z1
5 Microstrip line of characteristic impedance Z2
6 Microstrip line of characteristic impedance Z3
7 6-dB branch-line-shaped directional coupler
8 4.7-dB branch-line-shaped directional coupler
9 3-dB branch-line-shaqed directional coupler
7*a*, 8*a*, 9*a*, 43*a* Input port
7*b*, 8*b*, 9*b*, 43*b* Isolation port
7*c*, 8*c*, 9*c*, 43*c* First output port
7*d*, 8*d*, 9*d*, 43*d* Second output port
10, 11, 12, 25 Impedance converter
13, 14, 15, 53, 54, 55 Terminating resistor
21, 31, 41 Input terminal
22*a* to 22*d*, 32*a* to 32*d*, 42*a* to 42*d* Output terminal
23, 24, 51, 52 Transmission line
33*a* to 33*c*, 45 3-dB directional coupler
43 6-dB directional coupler
44 4.7-dB directional coupler
101 Output line
102*a* to 102*d* Input line
107*a*, 108*a*, 109*a* Output port
107*c*, 108*c*, 109*c* First input port
107*d*, 108*d*, 109*d* Second input port
121 Output terminal
122*a* to 122*d* Input terminal

DETAILED DESCRIPTION OF THE PREFERRED EMBODIMENTS

The present invention is described below by referring to the accompanying drawings showing the embodiments.

(Embodiment 1)

FIG. 1 shows the four-way power splitter of the embodiment 1 of the present invention.

In FIG. 1, symbol 1 denotes an input line, 2*a* to 2*d* denote output lines, 3 and 4 denote microstrip lines of a characteristic impedance Z1, 5 denotes a microstrip line of a characteristic impedance Z2, 6 denotes a microstrip line of a characteristic impedance Z3, 7 denotes a 6-dB branch-line-shaped directional coupler, denotes a 4.7-dB branch-line-shaped directional coupler, 9 denotes a 3-dB branch-line-shaped directional coupler, 10, 11, and 12 denote impedance converters, 13, 14, and 15 denote terminating resistors, 7*a*, 8*a*, and 9*a* denote input ports, 7*b*, 8*b*, and 9*b* denote isolation ports, 7*c*, 8*c*, and 9*c* denote first output ports, and 7*d*, 8*d*, and 9*d* denote second output ports.

When assuming the input port 7*a* and the second output port 7*d* among four ports of the 6-dB branch-line-shaped directional coupler 7 as a first terminal pair and the isolation port 7*b* and the first output port 7*c* of the coupler 7 as a second terminal pair, the value of the impedance Z7 of the first terminal pair is made different from that of the impedance of the second terminal pair.

That is, in the configuration in FIG. 1, by selecting the impedance Z7 of the first terminal pair so as to be equal to Z0/$K^2$ (K is a value larger than 1), it is possible to realize the impedance Z1 of the microstrip lines 3 and 4 by an impedance 1/K times larger than the conventional impedance (that is, Z0) and the impedance Z3 of the microstrip line 6 by an impedance 1/$K^2$ times larger than the conventional impedance (that is, Z0).

In the case of this embodiment, the impedance of the second terminal pair is constituted as a reference impedance Z0 (50 Ω in general)

Moreover, as for the 4.7-dB and 3-dB branch-line-shaped directional couplers 8 and 9, the both terminal pairs are constituted of the reference impedance Z0.

Furthermore, the impedance converters 10, 11, and 12 are constituted of microstrip lines having a line length of a quarter wavelength.

Operations of a four-way power splitter having the above constitution are described below.

An input signal (P) input through the input line 1 is input to the input port 7*a* of the 6-dB branchline-shaped directional coupler 7 after passing through the impedance converter 10. In this case, the impedance viewing the input line-1 side from the input port 7*a* is converted into the impedance Z7 from the reference impedance Z0.

In the 6-dB branch-line-shaped directional coupler 7, ¼ the signal (P) input to the input port 7*a*, that is, a (P/4) signal is output from the first output port 7*c* and the remaining (3P/4) signal is input to the input port 8*a* of the 4.7-dB branch-line-shaped directional coupler 8 after passing through the impedance converter 11 from the second output port 7*d*. In this case, the impedance viewing the second output port-7*d* side from the input port 8*a* is converted into the impedance Z0 from the impedance Z7.

In the 4.7-dB branch-line-shaped directional coupler 8, ⅓ the signal (3P/4) input to the input port 8*a*, that is, a (P/4) signal is output from the first output port 8*c* and the remaining (P/2) signal is input to the input port 9*a* of the 3-dB branch-line-shaped directional coupler 9 after passing through the impedance converter 12 from the second output port 8*d*.

In the 3-dB branch-Line-shaped directional coupler 9, the signal (P/2) input to the input port 9*a* is divided into two equal signals, a (P/4) signal is output from the first output port 9*c* and the second output port 9*d*, and a (P/4) signal is fetched from the output lines 2*a* to 2*d*, respectively. Thus, the directional coupler 9 operates as a four-way power splitter.

As described above, in the case of the configuration in FIG. 1, by selecting the impedance Z7 of the second terminal pair of the 6-dB branch-line-shaped directional coupler 7 so as to be equal to Z0/$K^2$, it is possible to reduce the impedance Z1 of the microstrip lines 3 and 4 constituting the 6-dB branch-line-shaped directional coupler 7 to an impedance 1/K times larger than the conventional Z0. Therefore, it is possible to increase the widths of the microstrip lines 3 and 4 and thereby, reduce loss. Moreover, because of the same reason, it is possible to constitute a power splitter having split s more than ever.

Though a branch-line-shaped directional coupler is constituted of microstrip lines in the above description, it is also possible to use other transmission lines.

Moreover, though an impedance converter is constituted of microstrip lines having a line length of a quarter wavelength in the above description, it is also possible to use other impedance conversion means.

Furthermore, though the impedance of the first terminal pair and that of the second terminal pair of only the 6-dB branch-line-shaped directional coupler 7 are constituted of values different from each other in the above description, it is also permitted to apply the above configuration to the 4.7-dB and 3-dB branch-line-shaped directional couplers 8 and 9.

Furthermore, though an impedance converter is used to connect branch-line-shaped directional couplers each other in the above description, it is apparent that the branch-line-shaped directional couplers similarly operate even if they are connected each other by a transmission line instead of the impedance converter when impedances of branch-line-shaped directional couplers to be connected are equal to each other.

Furthermore, though a four-way power splitter is constituted in the above description, it is apparent that a three-way power splitter and a five-way power splitter can be similarly constituted.

In addition to the above configurations, it is also possible to use a configuration for deciding the impedance Z7 of the first terminal pair of the 6-dB branch-line-shaped directional coupler 7 so that the characteristic impedance of the microstrip line between the input port 8*a* and the second output port 8*d* of the 4.7-dB branch-line-shaped directional coupler 8 becomes equal to the characteristic impedance of the microstrip line of the impedance converter 11.

Thereby, because widths of the both microstrip lines can be equalized each other, it is possible to eliminate the discontinuity between both line widths and reduce the loss between adjacent branch-line-shaped directional couplers. In this case, the relation is effected that the product between the impedance of the second output port 7*d* of the first branch-line-shaped directional coupler 7 and the impedance of the input port 8*a* of the second branch-line-shaped directional coupler 8 is equal to the second power of the characteristic impedance of the quarter-wavelength line between the input port 7*a* and the second output port 7*d* of the first branch-line-shaped directional coupler 7.

In the above description, loss is reduced by equalizing the characteristic impedance of the microstrip line between the input port 8*a* and the second output port 8*d* of the 4.7-dB branch-line-shaped directional coupler 8 with the characteristic impedance of the microstrip line of the impedance converter 11. Moreover, it is apparent that the same advantage can be obtained by equalizing the characteristic impedance of the microstrip line 6 between the input port 7*a* and the second output port 7*d* of the 6-dB branch-line-shaped directional coupler 7 with the characteristic impedance of the microstrip line of the impedance converter 11.

In the above case, the relation is effected that the product between the impedance of the second output port 7*d* of the first branch-line-shaped directional coupler 7 and the impedance of the input port 8*a* of the second branch-line-shaped directional coupler 8 is equal to the second power of the characteristic impedance of the quarter-wavelength line between the input port 8*a* and the second output port 8*d* of the second branch-line-shaped directional coupler 8.

(Embodiment 2)

Figure 2:
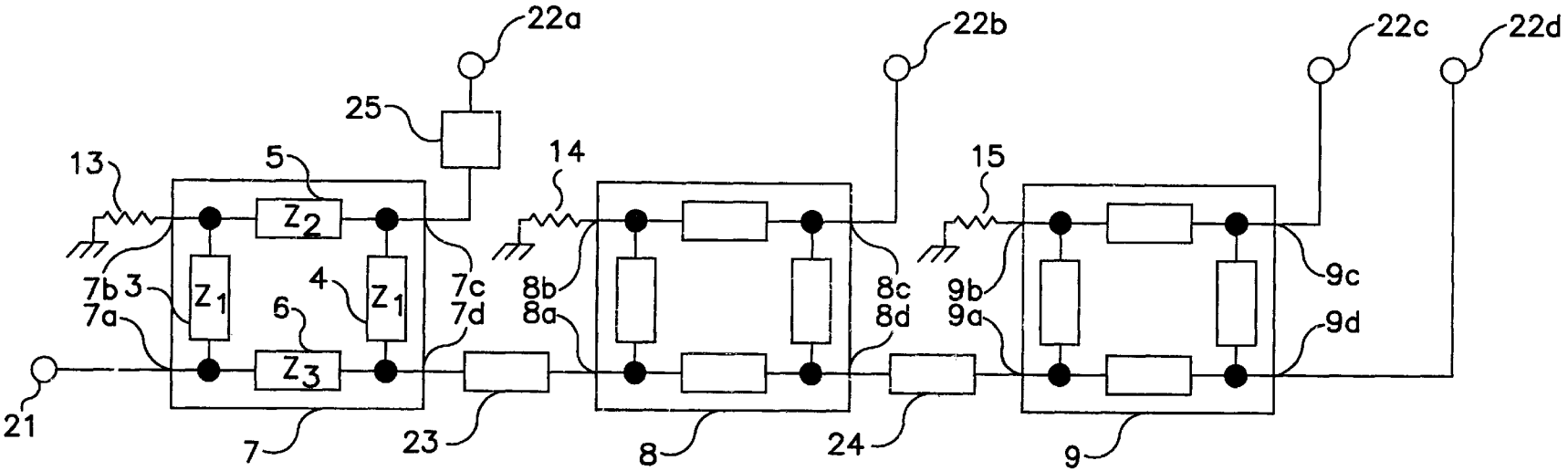
FIG. 2 is a block diagram of the four-way power splitter of embodiment 2 of the present invention.

FIG. 2 shows the four-way power splitter of the embodiment 2 of the present invention.

In FIG. 2, symbol 21 denotes an input terminal, 22*a* to 22*d* denote output terminals, 23 and 24 denote transmission lines, and 25 denotes an output impedance converter, in which a component same as that of the embodiment 1 is provided with the same symbol.

The following are main differences between this embodiment and the above embodiment 1.

That is, when assuming the input port 7*a* and output port 7*d* among four ports of the 6-dB branch-line-shaped directional coupler 7 as a first terminal pair and the isolation port 7*b* and first output port 7*c* as a second terminal pair, the impedance of the first terminal pair and that of the second terminal pair are constituted of values different from each other. In this case, the impedance of the first terminal pair is constituted as the reference impedance Z0 (50 Ω in general)

As for the 4.7- and 3-dB branch-line-shaped directional couplers 8 and 9, both terminal pairs are constituted of the reference impedance Z0.

Operations of a four-way power splitter having the above configuration are described below.

An input signal (P) input through the input terminal 21 is input to the input port 7*a* of the 6-dB branch-line-shaped directional coupler 7 and ¼ the input signal (P), that is, a (P/4) signal is fetched from the output terminal 22*a* after passing through the impedance converter 25 from the first output port 7*c* and the remaining (3P/4) signal is input to the input port 8*a* of the 4.7-dB branch-line-shaped directional coupler 8 after passing through the transmission line 23 from the second output port 7*d*.

In the 4.7-dB branch-line-shaped directional coupler 8, ⅓ the signal (3P/4) input to the input port 8*a*, that is, a (P/4) signal is fetched from the output terminal 22*b* after passing through the first output port 8*c* and the remaining (P/2) signal is input to the input port 9*a* of the 3-dB branch-line-shaped directional coupler 9 after passing through the transmission line 24 from the second output port 8*d*.

In the 3-dB branch-line-shaped directional coupler 9, the signal (P/2) input to the input port 9*a* is divided into two equal signals and a (P/4) signal is output from the output terminals 22*c* and 22*d*, respectively. Thus, the directional coupler 9 operates as a four-way power splitter.

It is possible to reduce the impedances of the microstrip lines 3 and 4 constituting the 6-dB branch-line-shaped directional coupler 7 by the configuration shown in FIG. 2 because of the reason to be described later. Therefore, it is possible to increase widths of the microstrip lines 3 and 4 as compared with conventional widths. Moreover, because of the same reason, it is possible to constitute a power splitter having split s more than ever.

That is, according to the configuration in FIG. 2, by selecting Z7*c* (corresponding to the impedance of the second terminal pair of the 6-dB branch-line-shaped directional coupler 7) so as to be equal to $Z0/K^2$, it is possible to realize the impedance Z1 of the microstrip lines 3 and 4 by an impedance 1/K times larger than the conventional impedance (that is, Z0) and the impedance Z2 of the microstrip line 5 by an impedance $1/K^2$ times larger than the conventional impedance (that is, Z0). By multiplying the value of the resistance terminating at an isolation port by $Z0/K^2$, the width of the microstrip line 5 increases and thereby, it is possible to reduce the loss of the 6-dB branch-line-shaped directional coupler 7. Moreover, as described above, it is possible to constitute a power splitter having split s more than ever.

In addition to the above configuration, it is also possible to use a configuration for deciding the value of the impedance Z7*c* of the second terminal pair of the 6-dB branch-line-shaped directional coupler 7 so that the impedance of the first output terminal 22*a* becomes equal to the characteristic impedance of the microstrip line of the output impedance converter 25.

Thereby, because the widths of both microstrip lines mentioned above can be equalized each other, it is possible to eliminate discontinuity between both line widths and reduce the loss at a joint.

In this case, the relation is effected that the product between the impedance of the first output port 7*c* of the first branch-line-shaped directional coupler 7 and the impedance of the first output terminal 22*a* is equal to the second power of the characteristic impedance of the quarter-wavelength line between the isolation port 7*b* and the first output port 7*c* of the first branch-line-shaped directional coupler 7.

Though a branch-line-shaped directional coupler is constituted of microstrip lines in the above description, it is also possible to use other transmission lines.

Moreover, though impedances of the first terminal pairs and second terminal pairs of only the 6-dB branch-line-shaped directional coupler 7 are constituted so as to have values different from each other in the above description, it is also permitted to apply the above configuration to the 4.7- and 3-dB branch-line-shaped directional couplers 8 and 9.

Furthermore, though a four-way power splitter is constituted in the above description, it is apparent that a three-way power splitter and a five-way power splitter can be similarly constituted.

In the above embodiments, it is possible to set the coupling degree of a Kth (K=1,2, . . . , N) branch-line-shaped directional coupler to, for example, $10\times\log_{10}(N-K+2)$ (dB).

Moreover, as a configuration for eliminating the discontinuity between widths of both microstrip lines and reducing loss, it is permitted to equalize the product between the impedance of the second output port of a Kth (K=1,2, . . . , N−1) branch-line-shaped-directional coupler and the impedance of the input port of a (K+1)th branch-line-shaped directional coupler with the second power of the characteristic impedance of the quarter-wavelength line between the input port and the second output port of the Kth branch-line-shaped directional coupler.

Moreover, it is permitted to equalize the product between the impedance of the second output port of a Kth branch-line-shaped directional coupler and the impedance of the input port of a (K+1)th branch-line-shaped directional coupler with the second power of the characteristic impedance of the quarter-wavelength line between the input port and the second output port of the (K+1)th branch-line-shaped directional coupler.

Furthermore, it is permitted to equalize the product between the impedance of the first output port of a Jth (J=1,2, . . . , N−1) branch-line-shaped directional coupler and the impedance of the Jth output terminal with the second power of the characteristic impedance of the quarter-wavelength line between the isolation port and the first output port of the Jth branch-line-shaped directional coupler.

Furthermore, FIG. 1 showing the embodiment 1 and FIG. 2 showing the embodiment 2 are configuration examples of the present invention but the present invention is not restricted to the examples.

In short, when a power splitter is constituted of N branch-line-shaped directional couplers, it is permitted to connect a second output port with an input port by a transmission line when the impedance of the second output port of a Kth (K=1,2, . . . , N−1) branch-line-shaped directional coupler is equal to the impedance of the input pore of a (K+1)th branch-line-shaped directional coupler and connect the second output port with the input port by an impedance converter when the former impedance is different from the latter impedance.

Moreover, in each branch-line-shaped directional coupler, when the impedance of the first output port is equal to the impedance of an output line connected to the first output port, it is permitted to directly connect the first output port with the output line and, when the former impedance is different from the latter impedance, it is permitted to connect the first output port with the output line by an impedance converter.

Similarly, when the impedance of the second output port of an Nth branch-line-shaped directional coupler is equal to the impedance of an output line connected to the second output port, it is permitted to directly connect the second output port with the output line and, when the former impedance is different from the latter impedance, it is permitted to connect the second output port with the output line by an impedance converter.

Moreover, for the above embodiments, a case is described in which the power supplied from an input port is distributed to a plurality of output ports. In the above configuration, it is possible to constitute a power combiner having the advantage same as the above as shown in FIGS. 3 and 4 by replacing an input port with an output port and replacing an input line (or input terminal) with an output line (or output terminal).

Figure 3:
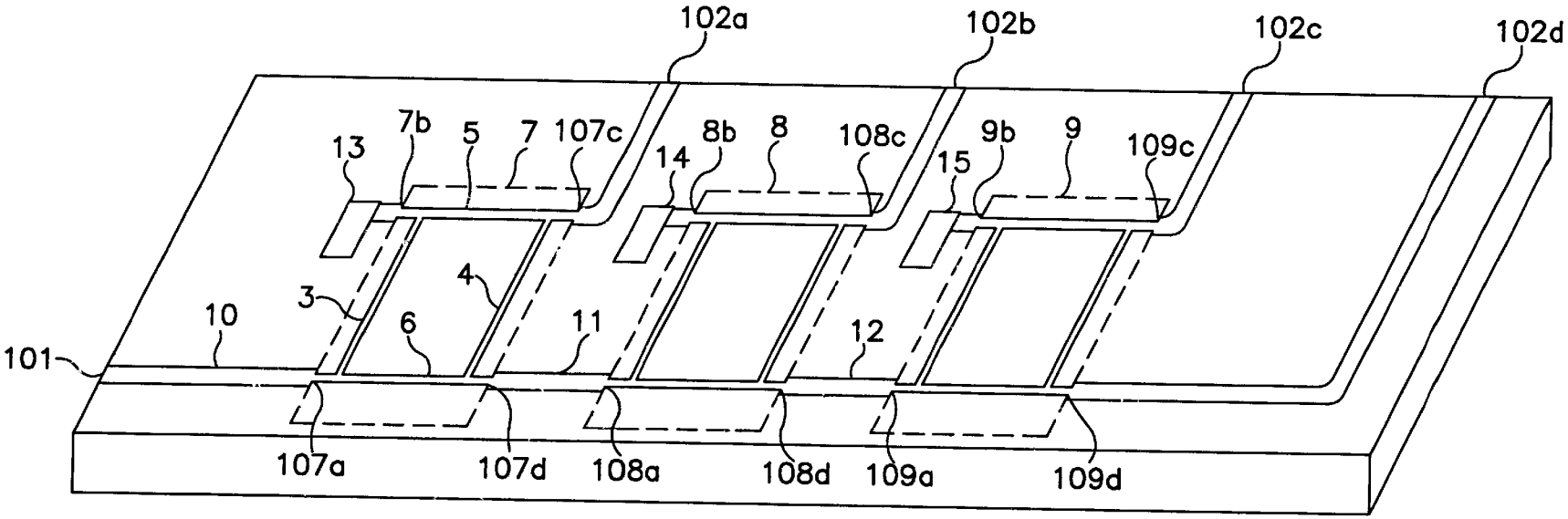
FIG. 3 is a block diagram of a power combiner corresponding to the four-way power splitter of the embodiment 1 of the present invention.

FIG. 3 is a block diagram of a power combiner for combining powers supplied from a plurality of input lines 102*a* to 102*d* and outputting the combined power from an output line 101. In FIG. 3, symbols 107*a*, 108*a*, and 109*a* denote output ports, 107*c*, 108*c*, and 109*c* denote first input ports, and 107*d*, 108*d*, and 109*d* denote second input ports.

Figure 4:
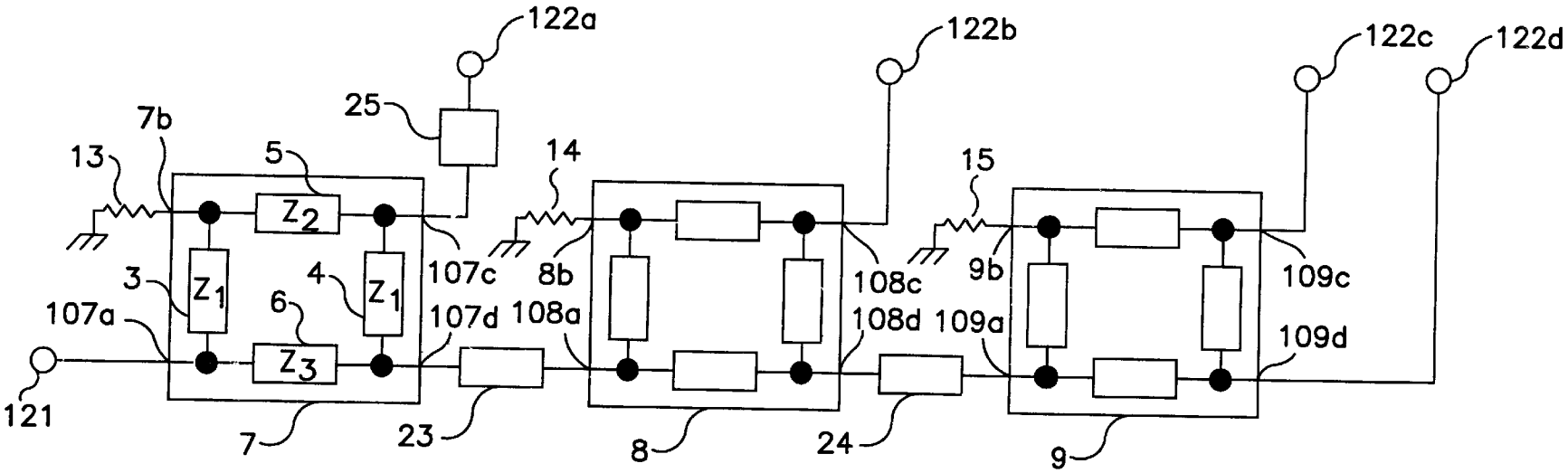
FIG. 4 is a block diagram of a power combiner corresponding to the four-way power splitter of the embodiment 2 of the present invention.
Figure 5:
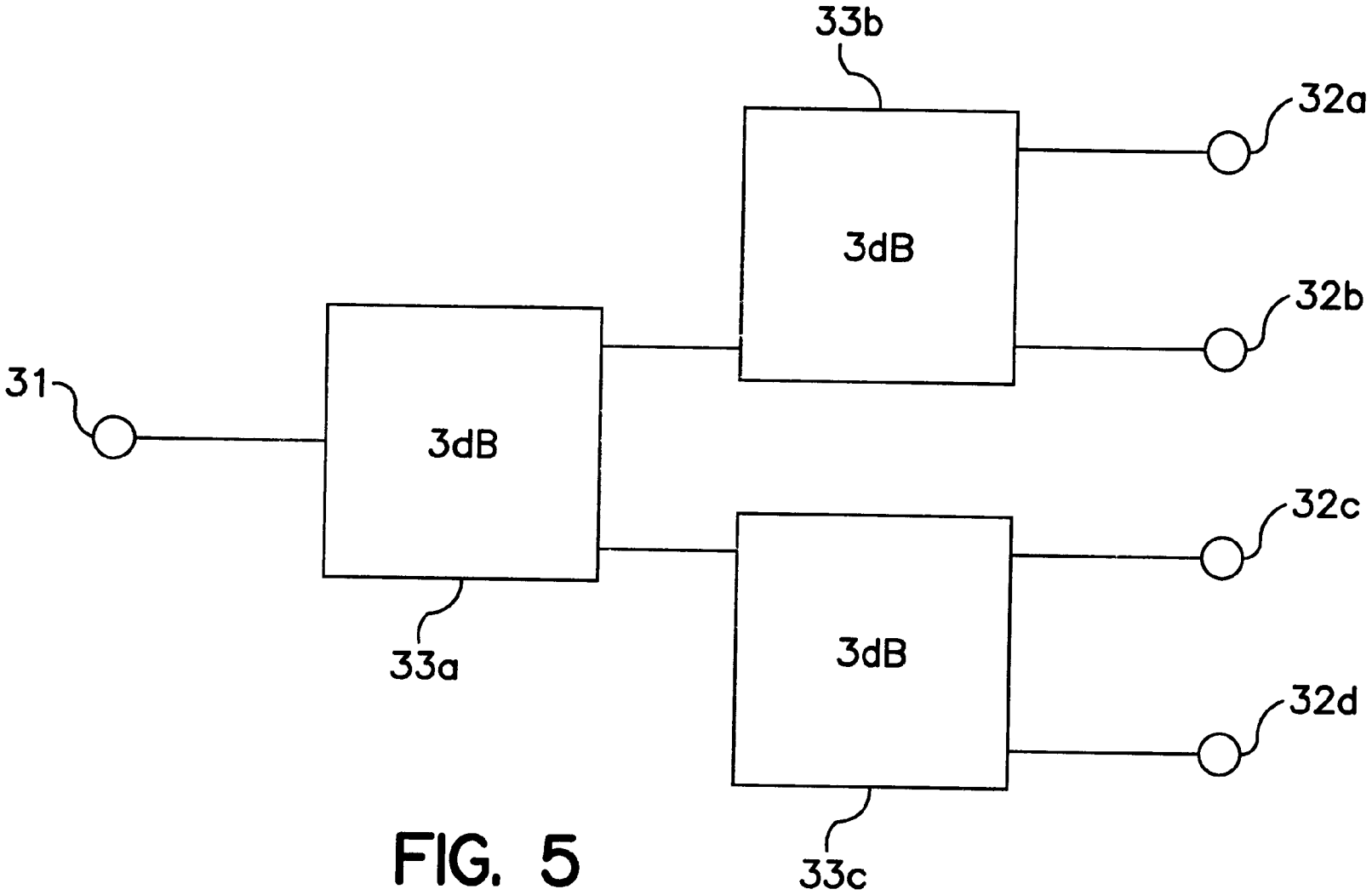
FIG. 5 PRIOR ART
FIG. 5 is a block diagram of a four-way power splitter combined with a conventional directional coupler having a coupling degree of 3 dB.
Figure 6:
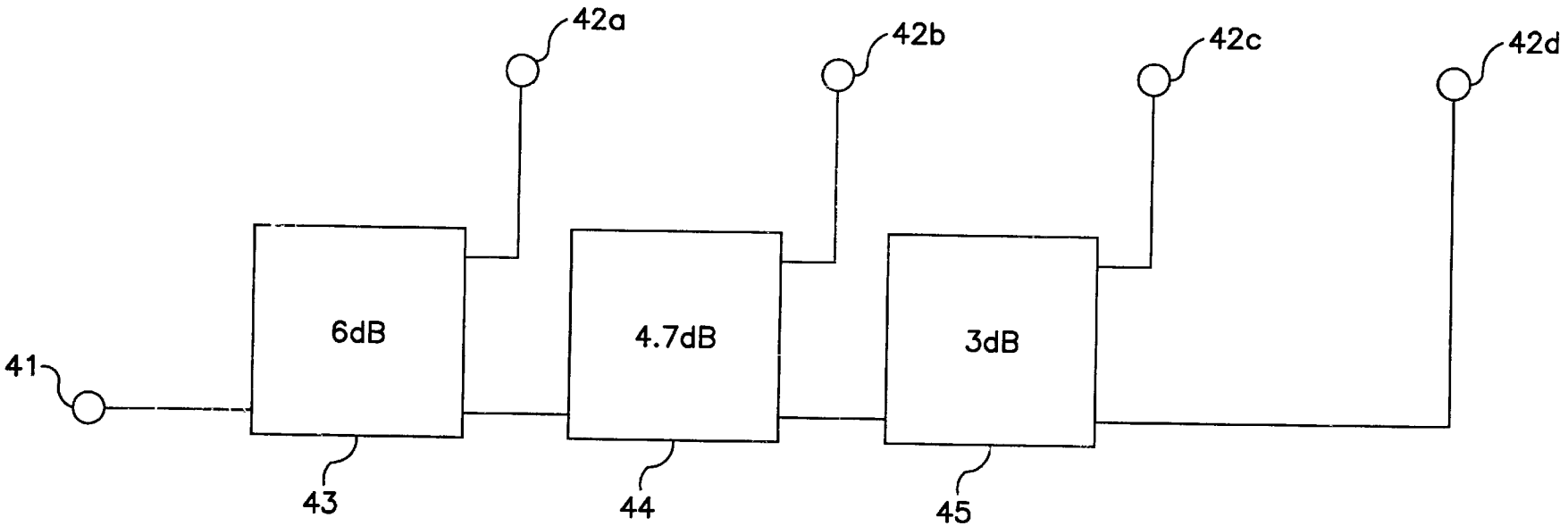
FIG. 6 PRIOR ART
FIG. 6 is a block diagram of a four-way power splitter constructed by cascading conventional directional couplers having coupling degrees 6, 4, 7, and 3 dB.
Figure 7:
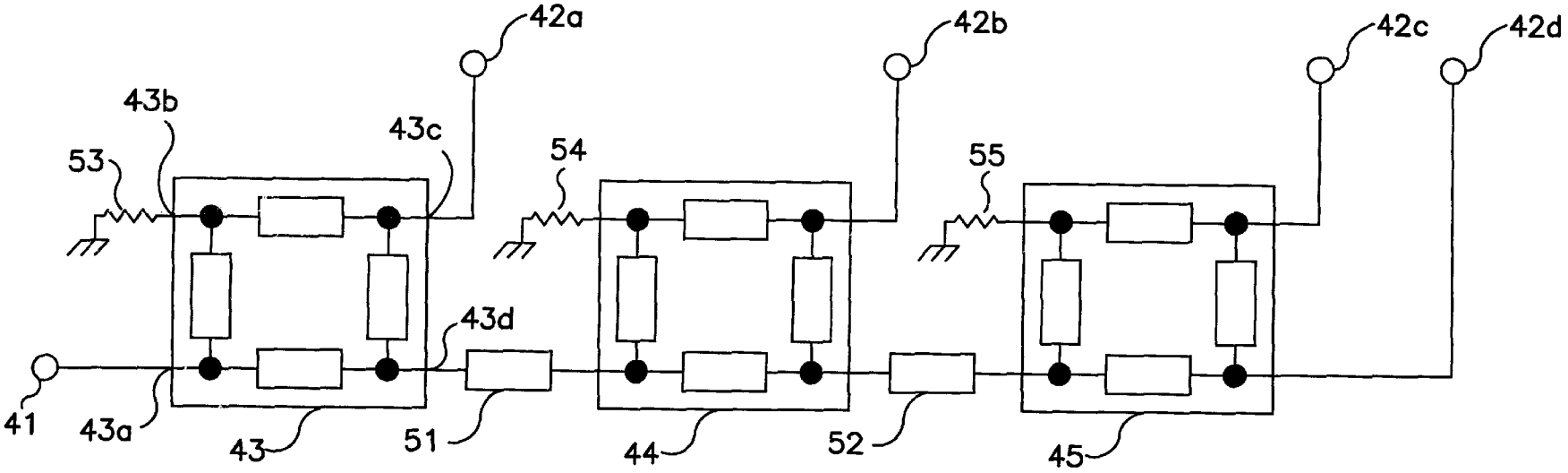
FIG. 7 PRIOR ART
FIG. 7 is a block diagram of a conventional four-way power splitter using a branch-line-shaped directional coupler.

FIG. 4 is another power combiner for combining powers supplied from a plurality of input terminals 122*a* to 122*d* and outputting the combined power from an output terminal 121. In FIG. 4, a component same as that in FIG. 3 is provided with the same symbol.

Thereby, when combining powers supplied from a plurality of inputs and outputting the combined power, an advantage is shown that it is possible to use input terminals more than ever and reduce loss as compared with a conventional case.

As described above, the present invention makes it possible to reduce the characteristic impedance of a transmission line constituting a directional coupler, realize a power splitter having more split s, and reduce loss by (1) making the impedance of a first terminal pair different from the impedance of a second terminal pair and (2) connecting adjacent directional couplers each other by an impedance converter when assuming an input port and a second output port as the first terminal pair and an isolation port and a first output port as the second terminal pair among four ports of a branch-line-shaped directional coupler in a power splitter constituted by cascading branch-line-shaped directional couplers.

As described above, the present invention has advantages that the number of split s can be increased and loss can be reduced, as compared with conventional cases.

Further, the present invention has advantages that it is possible to use input terminals more than ever and reduce loss as compared with a conventional case when combining powers supplied from a plurality of inputs and outputting the combined power.

What is claimed is:

1. A power splitter comprising:

N branch-line-shaped directional couplers, each respectively having four quarter-wavelength lines and each having an input port, an isolation port, a first output port, and a second output port;

an input line; and

N+1 output lines; wherein when an impedance of the input line is equal to an impedance of the input port of a first branch-line shaped directional coupler, the input line and the input port of the first branch-line-shaped directional coupler are connected through a transmission line having an impedance equal to the impedance of the input port of the first branch-line-shaped directional coupler or directly connected, and when the impedance of the input line is different from the impedance of the input port of the first branch-line-shaped directional coupler, the input line and the input port of the first branch-line-shaped directional coupler are connected through a first impedance converter;

when an impedance of the second output port of a Kth (K=1, 2, . . . , N−1) branch-line shaped directional coupler is equal to an impedance of the input port of a (K+1)th branch-line-shaped directional coupler, the second output port of the Kth branch-line-shaped directional coupler and the input port of the (K+1)th branch-line-shaped directional coupler are connected through a transmission line having an impedance equal to the impedance of the input port of the (K+1)th branch-line-shaped directional coupler or directly connected and when the impedance of the second output port of the Kth branch-line-shaped directional coupler is different from the impedance of the input port of the (K+1)th branch-line-shaped directional coupler, the second output port of the Kth branch-line-shaped directional coupler and the input port of the (K+1) branch-line-shaped directional coupler are connected through a Kth impedance converter;

when an impedance of the second output port of an Nth branch-line-shaped directional coupler is equal to an impedance of an (N+1)th output line, the second output port of the Nth branch-line-shaped directional coupler and the (N+1)th output line are connected through a transmission line having an impedance equal to the impedance of the (N+1)th output line or directly connected, and when the impedance of the second output port of the Nth branch-line-shaped directional coupler is different from the impedance of the (N+1)th output line, the second output port of the Nth branch-line-shaped directional coupler and the (N+1)th output line are connected through an (N+1)th impedance converter; and when the input port and the second output port of each branch-line-shaped directional coupler are used as a first terminal pair and the isolation port and the first output port of each branch-line-shaped directional coupler are used as a second terminal pair, an impedance of the first terminal pair is different from an impedance of the second terminal pair in at least one of the N branch-line-shaped directional couplers.

2. The power splitter according to claim 1, wherein the impedance of the second terminal pair is constituted as a reference impedance.

3. The power splitter according to claim 1, wherein the impedance of the first terminal pair is constituted as a reference impedance; and when an impedance of the first output port of a Jth (J=1, 2, . . . , N−1) branch-line-shaped directional coupler is equal to an impedance of a Jth output terminal, the first output port of the Jth branch-line-shaped directional coupler and the Jth output terminal are connected through a transmission line having an impedance equal to the impedance of the Jth output terminal or directly connected, and when the impedance of the first output port of the Jth branch-line-shaped directional coupler is different from the impedance of the Jth output terminal, the first output port of the Jth branch-line-shaped directional coupler and the Jth output terminal are connected through a Jth output impedance converter.

4. The power splitter according to claim 1, wherein the coupling degree of the Kth branch-line-shaped directional coupler is equal to $10\times\log_{10}(N-K+2)$ (dB), (K=1,2, . . . , N).

5. The power splitter according to claim 1, wherein the product between the impedance of the second output port of the Kth (K=1, 2, . . . , N−1) branch-line-shaped directional coupler and the impedance of the input port of the Kth branch-line-shaped directional coupler is equal to the second power of the characteristic impedance of the quarter-wavelength line between the input port and the second output port of the Kth branch-line-shaped directional coupler.

6. The power splitter according to claim 1, wherein the product between the impedance of the second output port of the Kth (K=1, 2, . . . , N−1) branch-line-shaped directional coupler and the impedance of the input port of the (K+1)th branch-line-shaped directional coupler is equal to the second power of the characteristic impedance of the quarter-wavelength line between the input port and the second output port of the (K+1) th branch-line-shaped directional coupler.

7. The power splitter according to claim 3, wherein the product between the impedance of the first output port of the Jth (J=1, 2, . . . , N−1) branch-line-shaped directional coupler and the impedance of the Jth output terminal is equal to the second power of the characteristic impedance of the quarter-wavelength line between the isolation port and the first output port of the Jth branch-line-shaped directional coupler.

8. The power splitter according to claim 1, wherein the N branch-line-shaped directional couplers are constituted of microstrip lines.

9. The power splitter according to claim 1, wherein the first impedance converter or the (N+1)th impedance converter is constituted of a transmission line.

10. A power combiner comprising:

N branch-line-shaped directional couplers, each respectively having four quarter-wavelength lines and each having an output port, an isolation port, a first input port, and a second input port;

an output line; and

N+1 input lines; wherein when an impedance of the output line is equal to an impedance of the output port of a first branch-line-shaped directional coupler, the output line and the output port of the first branch-line-shaped directional coupler are connected through a transmission line having an impedance equal to the impedance of the output port of the first branch-line-shaped directional coupler or directly connected, and when the impedance of the output line is different from the impedance of the output port of the first branch-line-shaped directional coupler, the output line and the output port of the first branch-line-shaped directional coupler are connected through a first impedance converter;

when an impedance of the second input port of a Kth (K=1, 2, . . . , N−1) branch-line-shaped directional coupler is equal to an impedance of the output port of a (K+1)th branch-line-shaped directional coupler, the second input port of the Kth branch-line-shaped directional coupler and the output port of the (K+1)th branch-line-shaped directional coupler are connected through a transmission line having an impedance equal to the impedance of the output port of the (K+1)th branch-line-shaped directional coupler or directly connected and when the impedance of the second input port of the Kth branch-line-shaped directional coupler is different from the impedance of the output port of the (K+1)th branch-line-shaped directional coupler, the second input port of the Kth branch-line-shaped directional coupler and the output port of the (K+1) branch-line-shaped directional coupler are connected through a Kth impedance converter;

when an impedance of the second input port of an Nth branch-line-shaped directional coupler is equal to an impedance of an (N+1)th input line, the second input port of the Nth branch-line-shaped directional coupler and the (N+1)th input line are connected through a transmission line having an impedance equal to the impedance of the (N+1)th input line or directly connected, and when the impedance of the second input port of the Nth branch-line-shaped directional coupler is different from the impedance of the (N+1) th input line, the second input port of the Nth branch-line-shaped directional coupler and (N+1)th input line are connected through an (N+1)th impedance converter; and when the output port and the second input port of each branch-line-shaped directional coupler are used as a first terminal pair and the isolation port and the first input port of each branch-line-shaped directional coupler are used as a second terminal pair, an impedance of the first terminal pair is different from an impedance of the second terminal pair in at least one of the N branch-line-shaped directional couplers.

11. The power combiner according to claim 10, wherein the impedance of the second terminal pair is constituted as a reference impedance.

12. The power combiner according to claim 10, wherein the impedance of the first terminal pair is constituted as a reference impedance; and when an impedance of the first input port of the Jth (J=1, 2, . . . , N−1) branch-line-shaped directional coupler is equal to an impedance of the Jth input terminal, the first input port of the Jth branch-line-shaped directional coupler and the Jth input terminal are connected through a transmission line having an impedance equal to the impedance of the Jth input terminal or directly connected, and when the impedance of the first input port of the Jth branch-line-shaped directional coupler is different from the impedance of the Jth input terminal, the first input port of the Jth branch-line-shaped directional coupler and the Jth input terminal are connected through a Jth input impedance converter.

13. The power combiner according to claim 10, wherein the coupling degree of the Kth branch-line-shape directional coupler is equal to $10\times\log_{10}(N-K+2)$ (dB), (K=1,2, . . . , N).

14. The power combiner according to claim 10, wherein the product between the impedance of the second input port of the Kth (K=1, 2, . . . , N−1) branch-line-shaped directional coupler and the impedance of the output port of the (K+1)th branch-line-shaped directional coupler is equal to the second power of the characteristic impedance of the quarter-wavelength line between the output port and the second input port of the Kth branch-line-shaped directional coupler.

15. The power combiner according to claim 10, wherein the product between the impedance of the second input port of the Kth (K=1, 2, . . . , N−1) branch-line-shaped directional coupler and the impedance of the output port of the (K+1)th branch-line-shaped directional coupler is equal to the second power of the characteristic impedance of the quarter-wavelength line between the output port and the second input port of the (K+1)th branch-line-shaped directional coupler.

16. The power combiner according to claim 11, wherein the product between the impedance of the first input port of the Jth (J=1, 2, . . . , N−1) branch-line-shaped directional coupler and the impedance of the Jth input terminal is equal to the second power of the characteristic impedance of the quarter-wavelength line between the isolation port and the first input port of the Jth branch-line-shaped directional coupler.

17. The power combiner according to claim 10, wherein the N branch-line-shaped directional couplers are constituted of microstrip lines.

18. The power combiner according to claim 10, wherein the first impedance converter or the (N+1)th impedance converter is constituted of a transmission line.

* * * * *

UNITED STATES PATENT AND TRADEMARK OFFICE

CERTIFICATE OF CORRECTION

PATENT NO. : 6,300,848 B1
DATED : October 9, 2001
INVENTOR(S) : Miyaji et al.

It is certified that error appears in the above-identified patent and that said Letters Patent is hereby corrected as shown below:

Title page,
Item [57], ABSTRACT,
Line 5, delete "7*a*".
Line 5, delete "7*d*".
Line 6, delete "7".
Line 9, delete "7*b*".
Line 9, delete "7*c*".
Line 10, delete "7".

Signed and Sealed this

Third Day of December, 2002

JAMES E. ROGAN
*Director of the United States Patent and Trademark Office*